United States Patent [19]

Sanden

[11] 3,954,315

[45] May 4, 1976

[54] CABINET DRAWER

[76] Inventor: Edwin H. Sanden, Box 215, Morrison, Colo. 80405

[22] Filed: Feb. 26, 1975

[21] Appl. No.: 553,173

[52] U.S. Cl. ..... 312/333; 312/342; 312/344

[51] Int. Cl.[2] ..... A47B 88/00

[58] Field of Search ..... 312/342, 333, 339, 340, 312/344; 292/DIG. 72

[56] References Cited

UNITED STATES PATENTS

| | | | |
|---|---|---|---|
| 287,386 | 10/1883 | Moore | 312/344 |
| 1,172,711 | 2/1916 | Hunter | 312/344 |
| 1,228,067 | 5/1917 | Severance | 312/333 |
| 2,496,673 | 2/1950 | Nielsen | 312/333 |
| 2,514,936 | 7/1950 | Cook | 312/333 |
| 2,859,070 | 11/1958 | Gomersall | 312/339 |
| 2,898,159 | 8/1959 | Arnit | 312/344 |
| 3,050,348 | 8/1962 | Pipe | 312/339 |
| 3,243,247 | 3/1966 | Knape | 312/333 |
| 3,664,716 | 5/1972 | Johnson | 312/339 |
| 3,701,577 | 10/1972 | Fischer | 312/339 |

*Primary Examiner*—Paul R. Gilliam
*Assistant Examiner*—Victor N. Sakran
*Attorney, Agent, or Firm*—Horace B. Van Valkenburgh; Frank C. Lowe

[57] ABSTRACT

Both the tracks attached to the inside of the side walls of a cabinet and the slides attached to the outside of the side walls of the drawer are inclined downwardly and outwardly, so that the drawer will normally move outwardly from the cabinet by gravity. A bump or upward arcuate indentation in the top flange of each drawer slide adjacent the front edge thereof will engage the roller of the respective cabinet track to hold the drawer in a closed position. A lip extending downwardly from the upward indentation will raise the drawer upwardly when it is pushed rearwardly, so that release of the drawer will then cause an impetus to be given to the drawer which will carry the indentation over the front roller and the drawer will automatically move to open position.

3 Claims, 5 Drawing Figures

CABINET DRAWER

This invention relates to tracks and slides for cabinet drawers, and more particularly to such tracks and slides which may be used in automatically opening the drawer.

It has been proposed, as in Knape U.S. Pat. No. 3,243,247, to slope the track, which is attached to the cabinet, and also to correspondingly slope the slide, which is attached to the drawer, downwardly and rearwardly, so that the drawer would automatically close by gravity after being opened and then released. However, there are numerous persons who, due to arthritis or other conditions, have difficulty in pulling open a drawer but are able to push against a drawer, as to close the drawer, for instance.

Among the objects of this invention are to provide a drawer and cabinet construction in which the drawer can be automatically opened without the necessity for pulling it; to provide a track for attachment to the cabinet and a special slide to be attached to the drawer, to permit the drawer to be opened by first pushing it rearwardly; to provide such a construction which is effective and efficient in use and may be installed without additional expense.

The foregoing and additional objects of the invention will become apparent from the following description, taken in conjunction with the accompanying drawings, in which.

Figure 1:
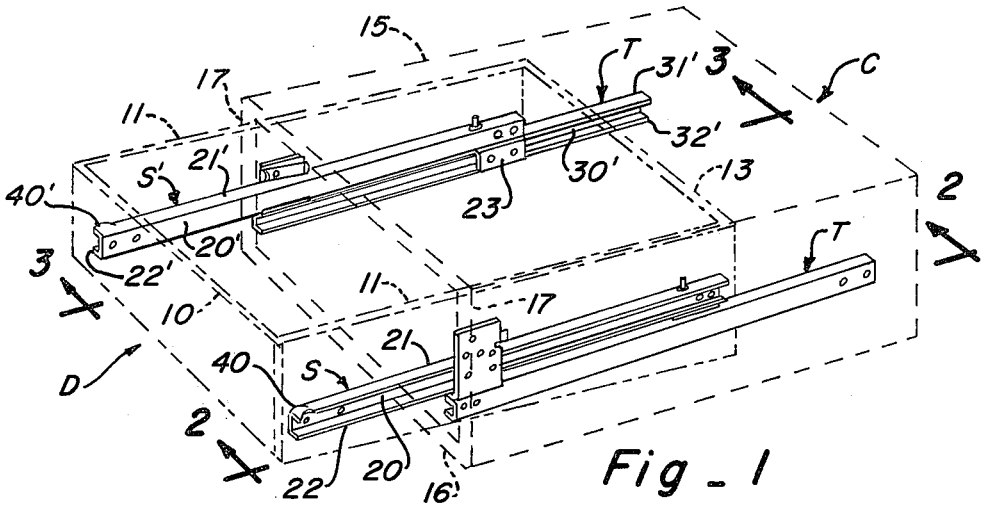
FIG. 1 is a phantom perspective view of a partially opened drawer and a portion of the cabinet in which it is used, together with the track and slide, at each side of the drawer and cabinet, respectively, shown in full.
Figure 2:
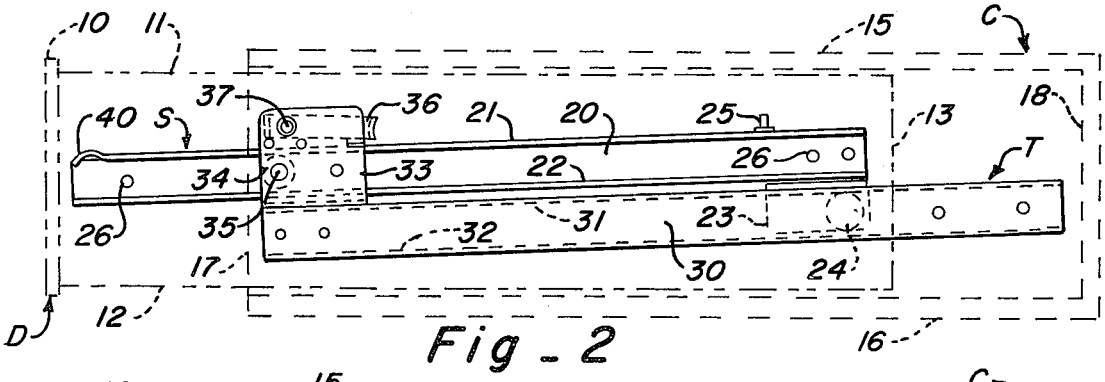
FIG. 2 is a vertical view taken from the position of line 2—2 of FIG. 1.
Figure 3:
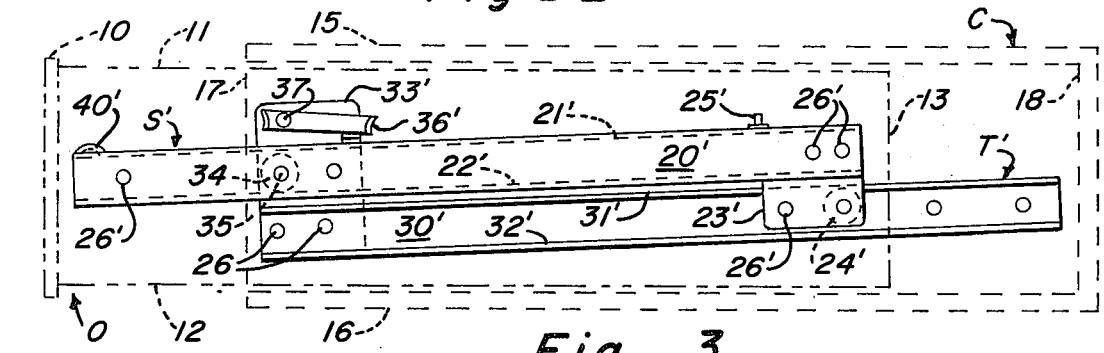
FIG. 3 is a vertical view, taken from the position of line 3—3 of FIG. 1.

As in FIG. 1, a drawer D may be installed within a cabinet C for inward and outward movement by the use of tracks T and T′ attached to the respective sides of the cabinet, and slides S and S′ attached to the respective sides of the drawer. It will be understood that there will normally be several drawers in a cabinet and a series of drawer spaces in a cabinet, such as in vertical relation. As shown, the front 10 of the drawer is not provided with a drawer pull, but the same may be provided, if desired. The front 10 of the drawer is attached to sides 11 and the bottom wall 12, the sides and bottom in turn being attached to the rear wall 13 of the drawer.

The space in cabinet C which receives drawer D includes a top 15, a bottom 16 and sides 17, with a rear wall 18 attached to each. As indicated previously, the side walls 17 of the cabinet may extend downwardly for a desired distance, in order to provide sufficient space for a desired number of drawers. Also, the top 15 and other corresponding parts may be duplicated laterally so that two or more drawers or drawer sections may be disposed side by side in the same cabinet.

The fixed tracks T and T′ are mounted on the inside of the respective sides 17 of the cabinet C, while the movable tracks or slides S and S′ are mounted on the outside of the respective side walls 11 of the drawer. The tracks T and T′ and the slides S and S′ are conventional in construction, with specific exceptions described later. Thus, each slide S and S′ is provided with a web 20, a top flange 21 and a bottom flange 22, with an extension bracket 23 at the rear end in which a roller 24 is mounted. The slide S′ is provided with a similar web 20′, top flange 21′, bottom flange 22′ and an extension bracket 23′ in which a roller 24′ is mounted. Each of slides S and S′ is provided with an upstanding stop pin 25 or 25′ near the rear end thereof for a purpose described later, and a series of screw holes 26 or 26′ in which appropriate screws, such as countersunk, may be installed to attach the web 20 or 20′ of the slides S and S′ to the respective side wall of the drawer.

The tracks T and T′ are similarly provided with webs 30, 30′, top flanges 31, 31′, bottom flanges 32, 32′ and extension brackets 33, 33′, in each of which a roller 34, 34′ is mounted, as by a roller pin 35 or 35′. The rollers 24, 24′ and 34, 34′ are preferably ball bearing rollers, to reduce the friction involved in the drawer moving forwardly. The tracks T and T′ are further provided with a stop lever 36 or 36′ which is pivoted on a pin 37 on a upward extension of the bracket 33 or 33′ for relatively easy removal of the drawer from the cabinet, as by pushing downwardly on the front end of stop brackets 36 and 36′ until the drawer stop pin 25 and 25′, respectively, move under the rear end of the bracket, then releasing the bracket, so that the drawer may be pulled on out. As will be evident, the roller 34 and 34′ of the track T and T′ fits within the corresponding slide S and S′, with the top flange 21 or 21′ of the corresponding slide running on the track roller 34 or 34′ at the front end of the track. The rollers 24 and 24′ of the slides S and S′ extend within the corresponding track T or T′, with the roller 24 sometimes bearing upwardly against the top flange 31 or 31′ of the corresponding track but, depending upon the position of the drawer, at other positions, bearing downwardly against the bottom flange 32 or 32′ of the corresponding track, as when the drawer is in a rearward position.

In accordance with this invention, each track T and slide S is installed in a parallel, forwardly slanting position, with the pitch being slightly exaggerated in the drawings for clarity of illustration. Any suitable pitch which will produce the desired results may be utilized, although a pitch of 7/16 inch for a 16 inch track or ⅝ inch for a 24 inch track will normally be found suitable. As will be evident, as soon as drawer D is started forwardly in its movement, the pitch of the tracks and slides is such that gravity will cause the drawer to move forwardly until each stop pin 25 engages the corresponding stop bracket 36. Thus, the drawer may be made automatically opening.

Figure 4:
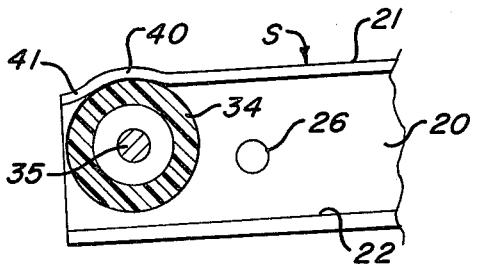
FIG. 4 is an enlarged detail, in longitudinal section, at the front end of the drawer slide showing also the roller mounted on the cabinet track, with the drawer in closed position.

In further accordance with this invention, and in order to retain the drawer in a rear position and permit opening movement of the drawer to be initiated with a push on the drawer which moves it rearwardly, an arcuate configuration or bump 40 or 40′ may be placed in the front end of the upper flange 21 and 21′ of the respective slides. As illustrated in FIG. 4, the drawer may be pushed rearwardly to a position in which the arcuate bump 40 or 40′ engages an arc of the circumference of roller 34 or 34′. This frictional engagement is sufficient to hold the drawer in closed position if the pitch of the drawer slides and tracks is not too great, and the angular engagement of the bump 40 and 40' with the rollers 34 and 34' is sufficient.

Figure 5:
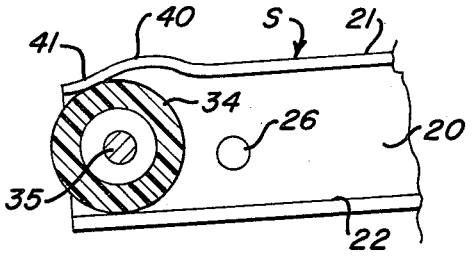
FIG. 5 is an enlarged detail similar to FIG. 4, but showing the drawer slide pushed rearwardly to initiate automatic forward movement of the drawer.

As indicated previously, the drawer can be opened by pushing it rearwardly. As shown in FIG. 5, this causes a lip 41, which is forwardly of the bump 40, to ride up on the roller 34, with the opposite slide and track operating in a similar manner. With each drawer slide so elevated, release of the drawer will permit the drawer to move forwardly and downwardly until the position corresponding to FIG. 4 is reached. However, the momentum of the forward movement of the drawer, due to the impetus from lip 41, will be sufficient to cause the drawer to continue to move forwardly by gravity only and to move to open position. It will be noted that the lower edge of lip 41 is below the plane of flange 21 and therefore, in the position of FIG. 5, the front of the drawer will be elevated above the position of FIG. 4 and also above the position which the drawer slides would assume if the bump 40 and lip 41 were to be eliminated.

Although a preferred embodiment of this invention has been illustrated and described, it will be evident that other embodiments may exist and other changes may be made without departing from the spirit and scope of this invention.

What is claimed is:

1. A device for opening a drawer having side walls and disposed in a cabinet having upright side walls and an upright front wall, comprising:

an inwardly facing channel track mounted on each side wall of said cabinet to slope downwardly from rear to front, said tracks being mounted at corresponding vertical positions;

an outwardly facing channel slide mounted on each side wall of said drawer in a position parallel to the corresponding track and sloping downwardly from rear to front at a corresponding angle;

each said track including mounting means for a roller adjacent the front of said track and engaged by an upper flange of the corresponding slide;

each said upper flange of each slide having an arcuate, upwardly extending indentation engaged by said roller with said drawer closed, said indentation corresponding in shape to the periphery of said roller and adapted to engage said slide roller to maintain said drawer in closed position against gravity; and the front edge of said indentation having a sufficient extent to permit said drawer to be pushed inwardly from closed position to cause the front of said indentation to rock up onto said roller and cause said slide and drawer to be moved upwardly and then move downwardly on release, thereby causing said drawer to move to a fully open position after said drawer is pushed rearwardly and released.

2. A device as defined in claim 1, wherein:

said indentation has a downwardly extending lip at the front end of said flange.

3. A device as defined in claim 2, wherein:

the front lower edge of said lip is below the plane of the upper flange of the corresponding slide.

* * * * *